US009146081B2

(12) United States Patent
Chu et al.

(10) Patent No.: US 9,146,081 B2
(45) Date of Patent: Sep. 29, 2015

(54) ADAPTIVE GUNNER PROTECTION KIT

(71) Applicant: BAE Systems Land & Armaments, L.P., Santa Clara, CA (US)

(72) Inventors: Peter C. Chu, San Mateo, CA (US); Brian H. Kariya, Los Gatos, CA (US); John Henry Armstrong, San Jose, CA (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 34 days.

(21) Appl. No.: 13/625,539

(22) Filed: Sep. 24, 2012

(65) Prior Publication Data

US 2014/0083284 A1 Mar. 27, 2014

Related U.S. Application Data

(60) Provisional application No. 61/538,605, filed on Sep. 23, 2011.

(51) Int. Cl.

| | |
|---|---|
| ***F41H 5/20*** | (2006.01) |
| ***F41H 7/04*** | (2006.01) |
| ***F41H 5/013*** | (2006.01) |
| ***F41H 5/16*** | (2006.01) |

(52) U.S. Cl.

CPC ..... *F41H 7/048* (2013.01); *F41H 5/013* (2013.01); *F41H 5/16* (2013.01); *F41H 5/20* (2013.01); *F41H 7/044* (2013.01)

(58) Field of Classification Search

CPC ..... F41H 7/04; F41H 5/14; F41H 7/02; F41H 5/20; F41A 23/24; F41A 27/18; F41A 23/34; F41A 27/20

USPC ..... 89/36.01, 36.02, 36.03, 36.07, 36.08, 89/36.09, 36.12, 36.13, 36.14, 36.15, 89/37.02, 37.03, 37.14, 40.03

See application file for complete search history.

(56) References Cited

U.S. PATENT DOCUMENTS 6,302,010 B1 * 10/2001 Holler ..... 296/187.07
7,478,580 B1 1/2009 Parimi et al.

(Continued)

FOREIGN PATENT DOCUMENTS

GB 12302 8/1916
GB 128317 6/1919
GB 2461750 A * 1/2010 ..... F41A 23/20

OTHER PUBLICATIONS

International Search Report for PCT Application PCT/US2012/056922, dated Jul. 1, 2013, 4 pgs.

(Continued)

*Primary Examiner* — Benjamin P Lee
(74) *Attorney, Agent, or Firm* — Patterson Thuente Pedersen, P.A.

(57) ABSTRACT

A gunner protection system for positioning armored panels around a hatch opening and a mounted weapon or equipment system. The armored panels are arranged to create an armored envelope surrounding the vehicle hatch and defining an opening through which the weapon or equipment system can be operated. The armored panels can be individually raised to define a portion of the armored envelope or lowered to change the geometry of the armored envelope or opening according to the particular weapon or equipment system. Similarly, all of the armored panels can be lowered to collapse the armorer envelope to allow for efficient transport of the vehicle with the gunner protection system attached to the vehicle.

20 Claims, 13 Drawing Sheets

(56) References Cited

U.S. PATENT DOCUMENTS

| | | | | |
|---|---|---|---|---|
| D610,038 | S * | 2/2010 | Kiel et al. | D12/12 |
| D619,044 | S * | 7/2010 | Kiel et al. | D12/12 |
| D622,182 | S * | 8/2010 | Parimi et al. | D12/12 |
| 7,832,325 | B1 * | 11/2010 | Hamann | 89/36.13 |
| 7,895,932 | B1 | 3/2011 | Ohnstad | |
| 7,942,092 | B1 | 5/2011 | Kiel et al. | |
| 7,946,210 | B1 | 5/2011 | Schneider et al. | |
| 8,006,606 | B1 | 8/2011 | Petrosillo | |
| 8,146,476 | B2 * | 4/2012 | Schneider et al. | 89/36.08 |
| 8,196,503 | B1 * | 6/2012 | Ran et al. | 89/36.07 |
| 8,342,073 | B2 * | 1/2013 | Chu et al. | 89/36.01 |
| 8,402,877 | B1 * | 3/2013 | Petrosillo et al. | 89/36.03 |
| 8,434,395 | B1 * | 5/2013 | Petrosillo et al. | 89/36.01 |
| 2005/0188831 | A1 * | 9/2005 | Squires et al. | 89/36.02 |
| 2005/0188832 | A1 * | 9/2005 | Tsatsis | 89/36.13 |
| 2007/0000377 | A1 * | 1/2007 | Ohnstad | 89/36.13 |
| 2009/0120274 | A1 | 5/2009 | Schneider et al. | |
| 2010/0005644 | A1 * | 1/2010 | Schneider et al. | 29/525.11 |
| 2010/0126337 | A1 * | 5/2010 | Carter | 89/36.02 |
| 2011/0126697 | A1 * | 6/2011 | Schneider et al. | 89/36.08 |
| 2011/0154981 | A1 * | 6/2011 | Schneider et al. | 89/36.08 |
| 2011/0167996 | A1 * | 7/2011 | White et al. | 89/36.01 |
| 2011/0197747 | A1 * | 8/2011 | Schneider et al. | 89/36.08 |
| 2012/0036989 | A1 * | 2/2012 | Kachtan et al. | 89/36.08 |
| 2013/0009420 | A1 * | 1/2013 | Ackermann | 296/26.05 |
| 2013/0220109 | A1 * | 8/2013 | Berkovich et al. | 89/36.13 |

OTHER PUBLICATIONS

International Preliminary Report on Patentability from related PCT Application PCT/US2012/056922, dated Apr. 3, 2014, 6 pgs.

Extended European Search Report from EP Application EP12858865.4, dated Apr. 9, 2015, 4 pgs.

* cited by examiner

ADAPTIVE GUNNER PROTECTION KIT

RELATED APPLICATION

The present application claims the benefit of U.S. Provisional Application No. 61/534,605 entitled "Adaptive Gunner Protection Kit", filed Sep. 23, 2011, which is incorporated herein by reference in its entirety.

FIELD OF THE INVENTION

The present invention is directed to a gunner protection system for positioning armor panels on the roof of armored vehicles to create an armored envelope protecting gunners operating roof mounted weaponry or equipment. Specifically, the present invention is directed to an adaptive gunner protection system having armored panels that can be repositioned to change the geometry and size of the armored envelope to accommodate different weapons or equipment or to collapse the armored envelope for efficient transport of the vehicle.

BACKGROUND OF THE INVENTION

Lightly armored vehicles have recently seen increased use in urban combat situations in which a gunner operating a roof mounted weapon is often exposed to close quarter small arms fire and/or improvised explosive devices ("IEDs"). Accordingly, these vehicles are often retrofitted with gunner protection kits ("GPKs") that position armored panels or similar structures around the hatch of the vehicle to form an armored envelope shielding the upper body of a gunner operating the roof mounted weapon while standing in the hatch. The armored envelope typically defines an opening through which the weapon can be extended. The opening is typically sized to correspond to the type of weapon mounted and to provide sufficient visibility to allow the gunner to effectively aim and operate the weapon while still protecting the gunner from ballistic threats.

As shown in FIGS. 1, 1*a*, 1*b*, 1*c*, and 2, 2*a*, 2*b*,and 2*c*, the inherent challenge with sizing of the armored envelope as well as the opening is that necessary size and shape of the opening can vary substantially depending on the weapon and equipment mounted to the vehicle. With light or heavy machine guns such as M2, M240 or M249 machine guns, the opening defined by the armored envelope of the GPK is typically a narrow vertical slot through which the barrel of the machine gun can be extended. The vertical slot allows the gunner to rotate the gun within the vertical slot to aim the gun while shielding the gunner from ballistic threats. With large bore weapons such as MK19 grenade launcher or M120/M121 mortars, the larger diameter of the barrel of those weapons may not fit within the narrow vertical slot suitable for machine guns. Similarly, grenade launchers or mortars are often fired at angles approaching vertical so projectiles are filed toward the target on a parabolic trajectory. Thus the vertical slot used for machines guns cannot accommodate the high angles necessary to operate grenade launchers or mortars. While missile or rocket launchers are often fired at near horizontal angles compatible with the vertical slots used for machine guns, the launchers require substantially larger diameter slots through which the rocket or missile can pass through. In addition, the targeting system for the launcher is often offset from the launch tube itself requiring a second opening or an enlarged first opening through which the targeting system can be aimed.

In addition, the overall geometry of armored envelopes sized for machine guns and grenade launcher is often too small to fit the often substantially bulkier dimensions of missile or rocket launchers and other large weapon systems. The limited confines of the armored envelope can also present safety hazards for the gunner when operating missile launchers or other systems that produce significant back blast. Machine guns, grenade launchers and mortars produce no back blast. Accordingly, GPKs for those weapon systems typically do not include additional openings for venting back blast as doing so creates additional paths through which ballistic threats can travel. A similar drawback is that targeting systems used for painting targets for airstrikes or artillery fire are also often large and bulky making them incompatible with the often smaller envelope geometry created by GPKs for machine guns. The specific requirements of individual weapons and equipment systems typically requires that the entire GPKs be replaced when a different weapon or targeting system is to be mounted, thereby substantially increasing the logistical challenges of providing adequate protection for the gunner.

A similar challenge with GPKs is that the armored envelope formed by the GPK can substantially increase the overall height of the vehicle. The armored paneling must often extend a substantial distance above the top of the hatch to provide sufficient protection for the gunner. The armored envelope typically comprises paneling positioned around the hatch that is at least the height of the gunner's head. In addition, the armored envelope often comprises an armored roof for protecting the gunner from ballistic threats originating from above the vehicle. The top cover further increases the height of the armored envelope and the overall height of the vehicle. As the GPKs are often fitted to the vehicle before the armored vehicles are transported into the theater by ship or plane, the added height can make efficiently transporting the vehicles to the theater within the limited confines of a ship or plane difficult. Accordingly, GPKs are often separately transported and not fitted to the vehicle until after the vehicle has been transported into the theater. However, the inherent drawback of this approach is that the assembly process must be done in theater where maintenance and other equipment necessary for assembly may be more limited. In addition, the assembly process creates substantial downtime where the vehicle is otherwise ready for use, but is awaiting installation of the GPK.

Accordingly, there is a need for a means of providing an armored envelope for gunners that can be used with multiple weapons or targeting systems, while allowing for efficient transport of the vehicle into the theater.

SUMMARY OF THE INVENTION

The present invention is directed to an adapted gunner protection system that comprises a plurality of armored panels that can be arranged around the roof hatch of a vehicle to provide an armored envelope for protecting a gunner operating a roof mounted weapon or equipment system. The panels can be arranged to define at least one opening through which the weapon or equipment system can be operated. Each armored panel is rotatably mounted to the vehicle roof such that each panel can be individually raised to a generally vertical orientation to define a portion of the overall armored envelope or lowered to a position against the vehicle roof to increase the size of the armored envelope or create a second opening in the armored envelope. The individual positioning of the armored panels allows the size and shape of the armored envelope and opening to be customized for the particular weapon or equipment system mounted to the vehicle at that time. The armored envelope can be increased in size or provide additional openings for addressing back blast from certain weapon systems. Similarly, all of the panels can be lowered against the roof of the vehicle to collapse the armor panel without disengaging the panels from the vehicle allowing for efficient transport of the vehicle without the additional difficulty of attaching the armor system in theatre.

In one aspect, at least one of the armored panels can be upright when rotated into the vehicle orientation. In another aspect, at least one of the armored panels can be angled radially inward toward the center of the hatch when raised to the vertical orientation. In this configuration, two adjoining panels that are inwardly angled can be engaged together along a common edge, wherein the inward angle of the armored panels cooperates to maintain the panels in the generally vertical orientation without requiring an additional support structure to prevent the armored panels from collapsing inward from impacts to the exterior of the armored envelope. The inwardly angled armored panels also provide protection from ballistic threats directed from angles above the horizontal. In yet another, aspect, at least one of the panels can be angled outward to provide clearance for certain weapons and equipment system. Similarly, the outward angle of the panels can provide an angled surface for directing the back blast of certain weapon systems, such missiles, rockets or recoilless rifles, upwards away from the vehicle rather than downward toward the vehicle roof or back toward the weapon system or gunner. The panels are rotated radially outward to lower the panels into the generally horizontal position to collapse all or a portion of the armored envelope.

A gunner protection system, according to an embodiment of the present invention, comprises a mounting plate and a plurality of armored panels including at least two fore panels, at least two side panels and at least one rear panel combinable to define an armored envelope. Each fore panel can further comprise a hinged bracket for rotatably mounting the fore panel to the mounting plate. In one aspect, each fore panel can comprise a fold out portion that can be rotated between a first position in which the fold out portion is positioned against the fore panel and a second position in which the fold out portion extends outward from the fore panel to increase the size of the armored envelope. Each side panel can comprise a hinged bracket for rotatable mounting the side panel to the mounting plate and an engagement assembly for securing the side panel to one of the fore panels along common edge when the fore panel and side panel are positioned in a generally vertical orientation. The back panel can similarly comprise a hinged bracket for rotatably mounting the back panel to the mounting plate. The back panel can also comprise an engagement assembly for affixing the back panel to the adjoining side panels. In one aspect, the back panel can also comprise a fold out portion rotatable between a first position in which the fold out portion is positioned against the rear panel and a second position in which the fold out portion is extends from the rear panel such that the back panel and fold out portion defines a continuous planar surface.

In one aspect, the fore panels, side panels and back panel can be arranged to define a u-shaped armored envelope. In this configuration, the fore panels generally define the ends of the U such that the fore panels cooperate to define an opening in the armored panel through which the weapon or equipment system can be operated. Similarly, the side-panels define the arms of the U, while the back panel defines junction of the arms of the U. The individual panels can be raised and lowered according to the particular geometry of the armored envelope required for the specific weapon or equipment system mounted to the vehicle.

In an embodiment of the present invention, the fore panels, the side panels or back panel can each comprise a transparent armored window. The armored windows allow for increased visibility through the armored panels without requiring an additional slot or opening for providing a sight line through the armored envelope. In one aspect, the armored windows can be positioned in the armored panels to correspond to the sight lines of the gunner when operating the weapon or equipment system.

In an embodiment of the present invention, the gunner protection system can comprise a gun shield mountable to the weapon system. The gun shield further comprises an armored panel defining a slot for receiving the barrel or a portion of the action of a weapon system. The gun shield further comprises a weapon mount for attaching the panel to the weapon system. The gun shield is positioned on the weapon system such that the edges of the armored panel overlap with the edges of the opening defined by the fore panels to eliminate a direct path through the armored envelope between the gun shield and the fore panels. In one aspect, the overlap between the gun shield and fore panels can be sized such that the weapon system can be rotated and aimed during operation of the weapon system without creating gaps between the gun shield and fore panels.

A method of protecting a gunner operating a roof mounted weapon or equipment system, according to an embodiment of the present invention, comprises providing a plurality of armored panels each rotatable between a horizontal orientation and a generally vertical orientation. The method can further comprise arranging the plurality of armored panels around a hatch in a u-shaped configuration. The method also comprises rotating at least one of the armored panels into the generally vertical orientation to create an armored envelope providing ballistic protection for the gunner. The method can further comprise rotating at least one armored panel into the generally horizontal orientation to change the shape and size of the armored envelope.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
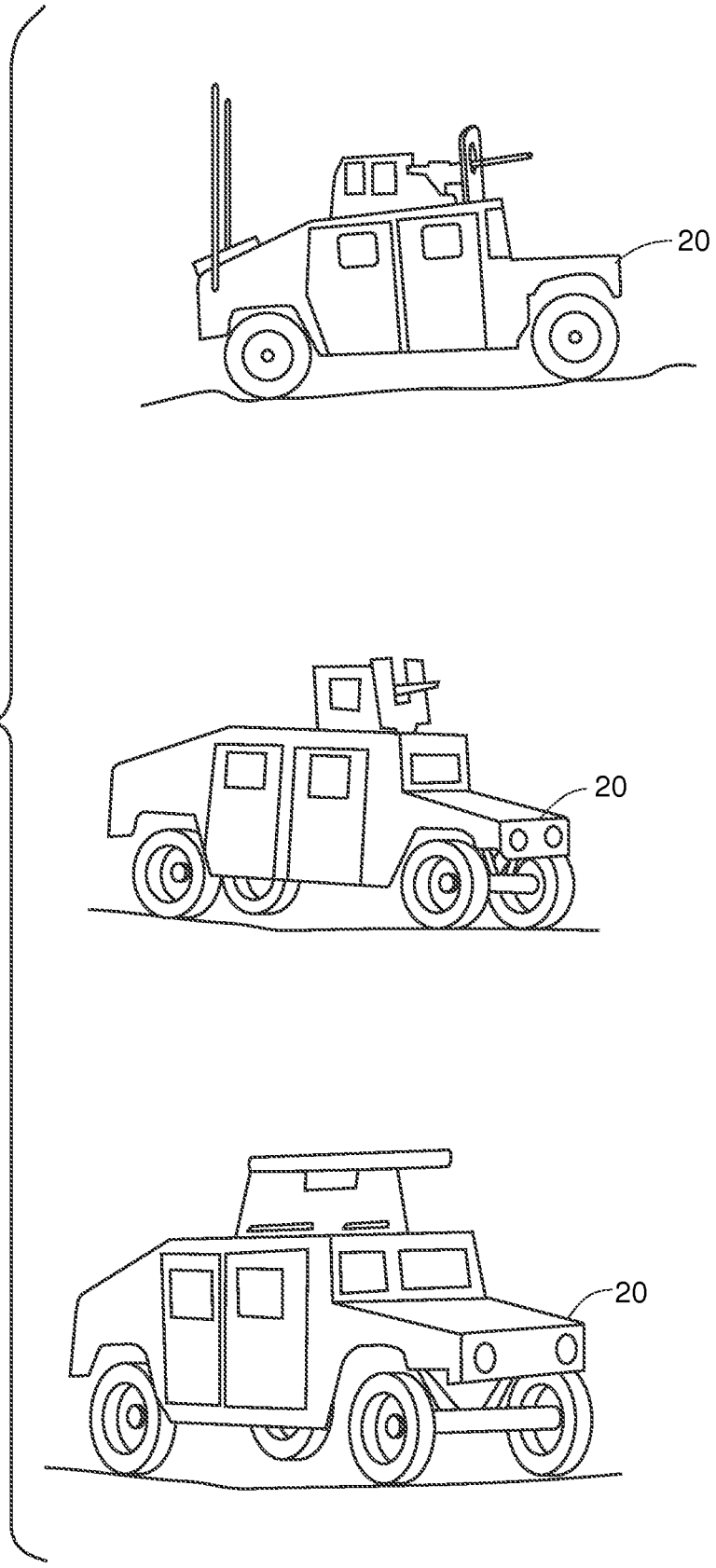
FIG. 1 is a set of perspective drawings depicting the prior art.
Figure 1A:
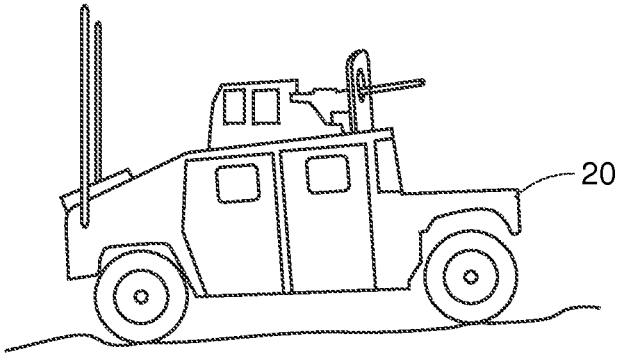
FIG. 1*a* is a side view of the prior art vehicle.
Figure 1B:
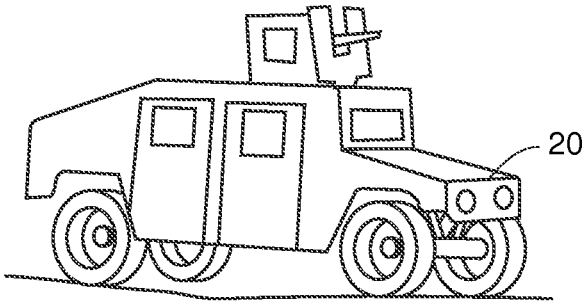
FIG. 1*b* is a perspective view of an embodiment of a prior art vehicle.
Figure 1C:
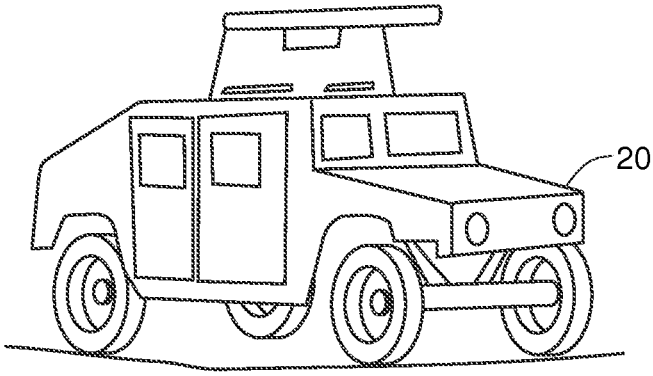
FIG. 1*c* is a perspective view of another embodiment of a prior art vehicle.
Figure 2:
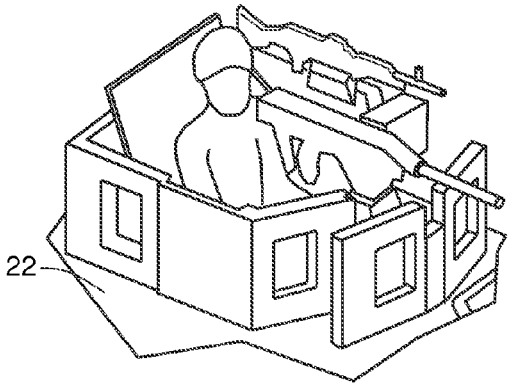
FIGS. 2-2*c* depict prior art incorporation of fixed turret systems.
Figure 2A:
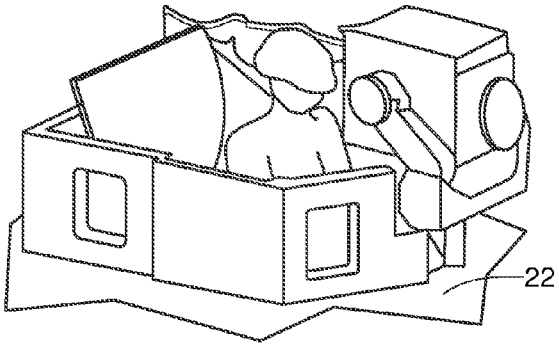
Figure 2B:
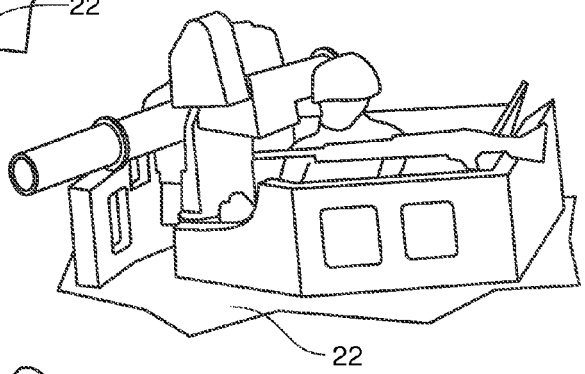
Figure 2C:
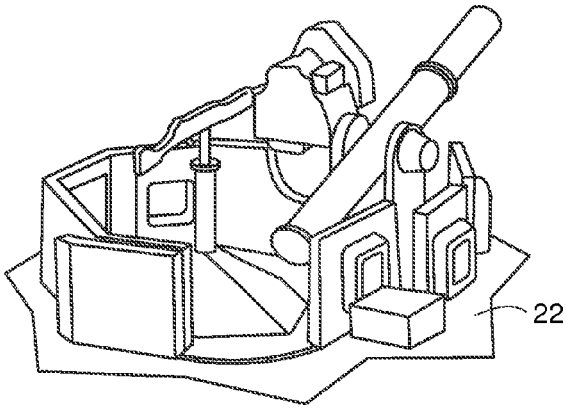
Figure 3:
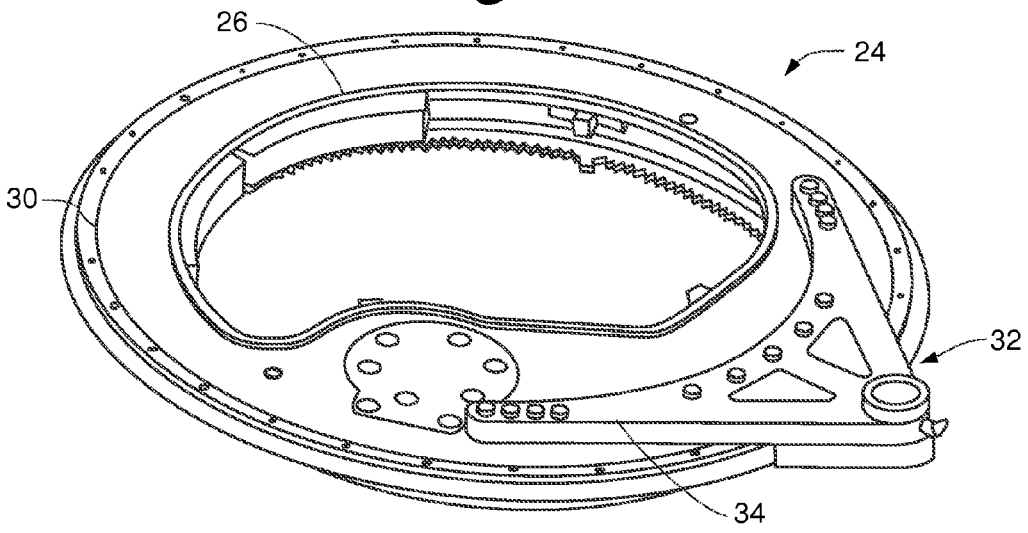
FIG. 3 is a perspective view of a hatch for use with the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE INVENTION

Figure 4:
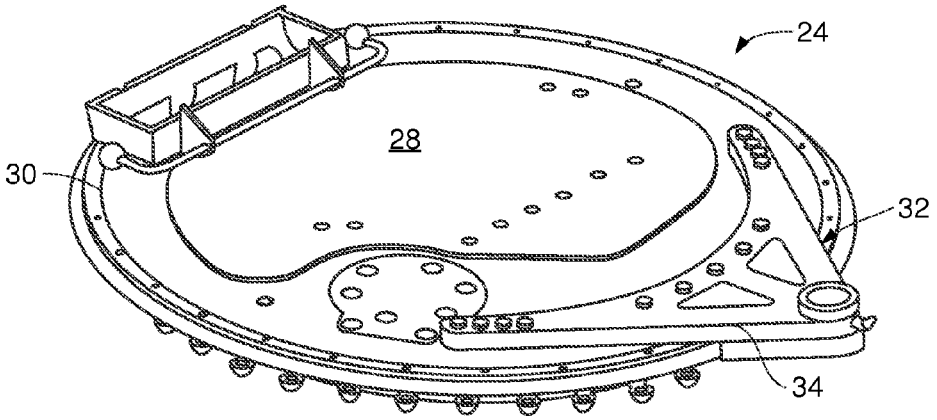
FIG. 4 is a perspective view of the hatch depicted in FIG. 3 with a hatch door positioned within the hatch.
Figure 5:
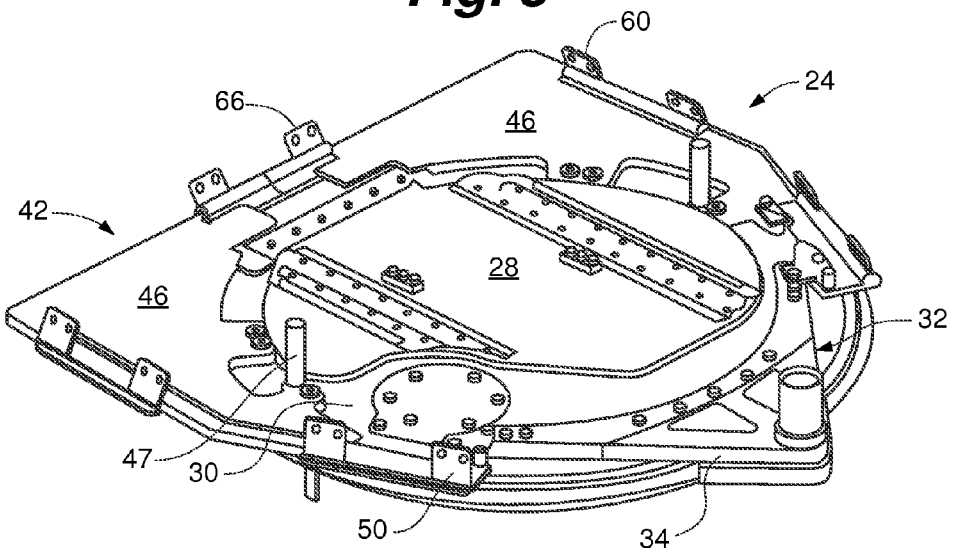
FIG. 5 is a front perspective view of a hatch with a mount assembly for attaching a plurality of armored panels according to an embodiment of the present invention.
Figure 6:
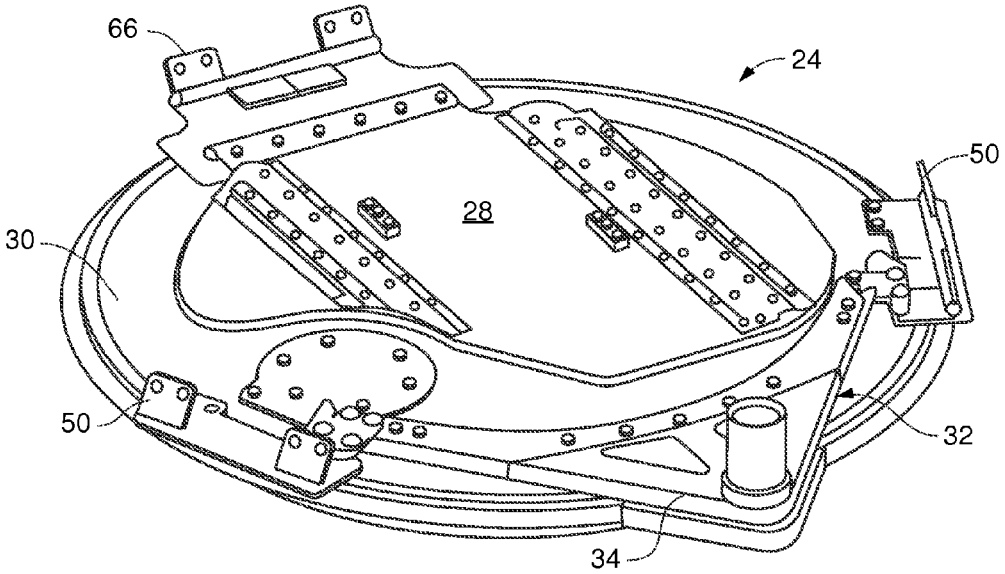
FIG. 6 is a front perspective view of a hatch with a plurality of hinged brackets for attaching a plurality of armored panels according to an embodiment of the present invention.
Figure 7:
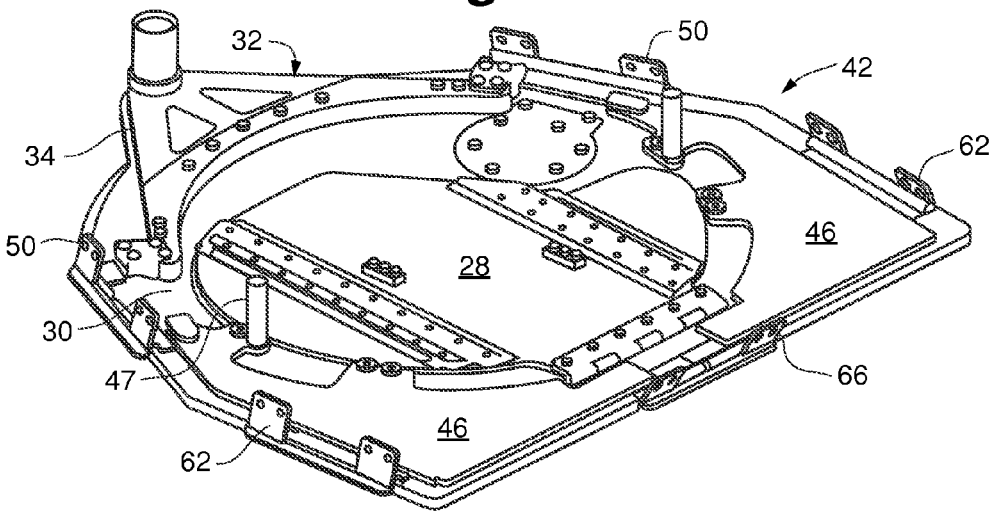
FIG. 7 is a rear perspective view of a hatch with a mount assembly for attaching a plurality of armored panels according to an embodiment of the present invention.

As depicted in FIGS. 3-7, a vehicle 20, for use with the present invention, comprising a roof 22 with a hatch 24 defining a hatch opening 26 through the roof 22. The hatch 24 further comprises a door 28 rotatable between a closed position in which the hatch door 28 is positioned within the hatch opening 26 to seal the hatch opening 26 and an open position in which the door 28 is rotated out of the hatch opening 26 to allow passage through the opening 26. As depicted in FIG. 5-7, the door 28 comprises a multi-fold hatch door such that the door 28 can be folded in half or thirds after the door 28 is rotated into the open position to reduce the footprint of the door 28 after opening. Alternatively, the door 28 can comprise a fixed panel door as depicted in FIG. 4. In one aspect, the hatch 24 can further comprise a hatch ring 30 encircling the hatch opening 26 and to which the hatch door 28 is rotatable mounted. In one aspect, the hatch ring 30 can comprise a weapon/equipment mount 32 for attaching various weapon or equipment systems. The roof weapon/equipment mount 32 is positioned on the roof 22 and can further comprise a weapon/equipment mount plate 34 for supporting and stabilizing a weapon or equipment system secured to the mount 32. For the purposes of this disclosure, a weapon or equipment system can include, but is not limited to machine guns, grenade launchers, mortars, missile or rocket launchers, recoilless rifles, laser designator systems and other conventional weapon or equipment systems.

As depicted in FIGS. 8-18, a gunner protection system 40, according to an embodiment of the present invention, comprises a mount assembly 42 and a plurality of armored panels 44. The mount assembly 42 can comprise at least one mount plate 46 having at least one edge contoured to follow the shape of the hatch opening 26. As depicted in FIGS. 9-15, each mount plate 46 is secured to the hatch ring 30 such that the mount plates 46 are positioned around the periphery of the hatch opening 26. In one aspect, the mount assembly 42 can comprise two mirrored mount plates 46 positioned on either side of the hatch opening 26 and extending at least partially along the periphery of the hatch opening 26. In one aspect, the gunner protection 40 can be a modular system in which securing the mount plates 46 to the hatch ring 30 secures the gunner protection system 40 the vehicle 20. In one aspect, each mount plate 46 can further comprise a handle 47 positioned for assisting the gunner in climbing through the hatch opening 26.

Figure 13:
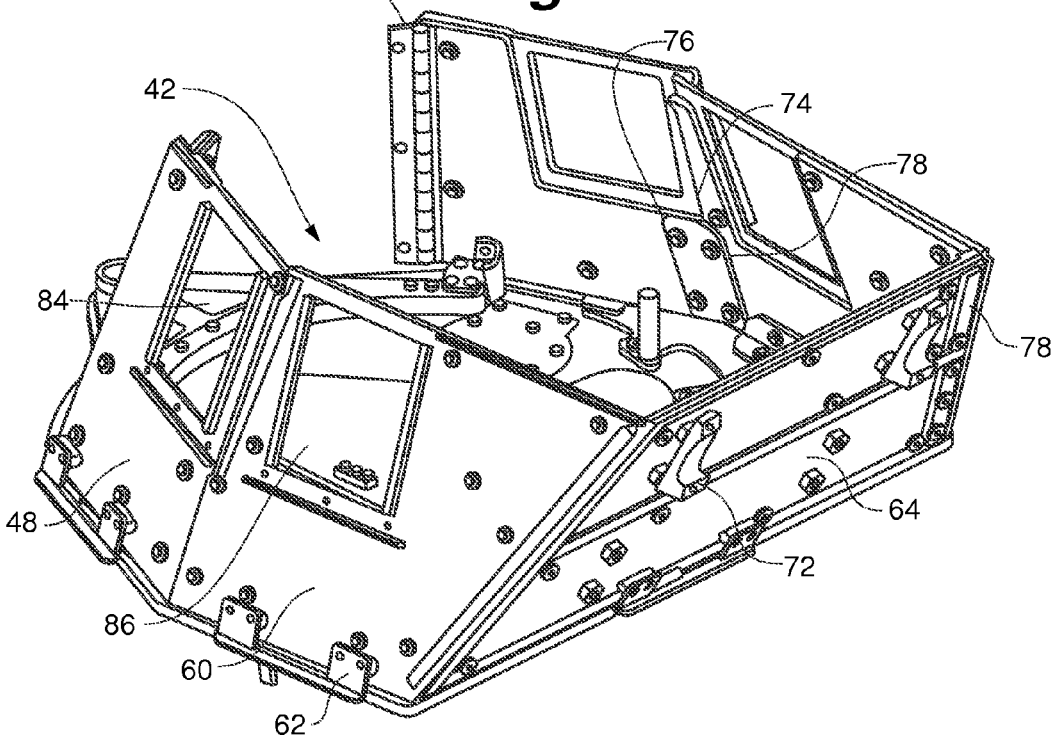
FIG. 13 is a rear perspective view of the hatch depicted in FIG. 12.
Figure 14:
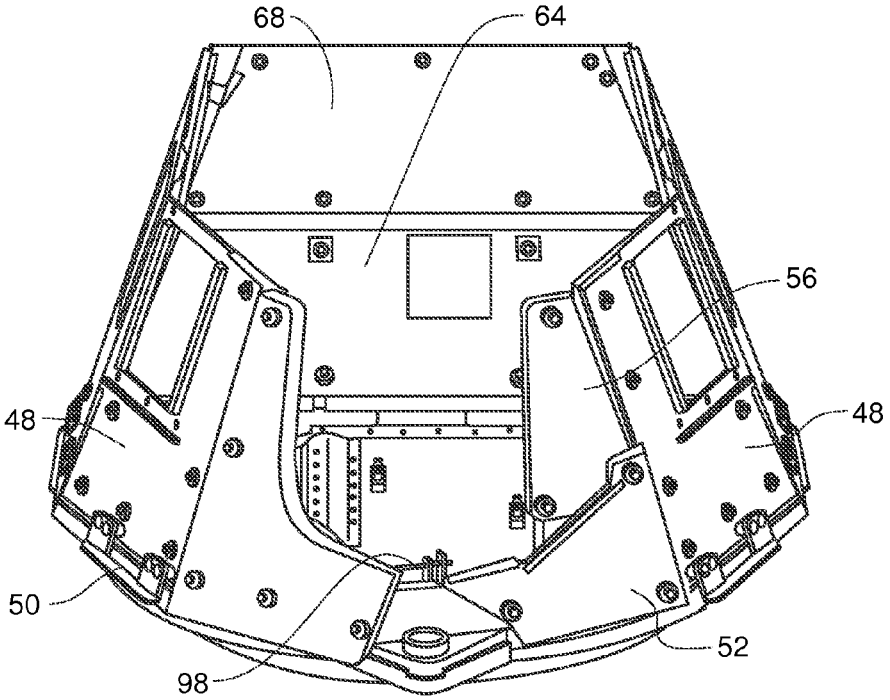
FIG. 14 is a frontal perspective view of the hatch depicted in FIG. 13 with both L-shaped fold out panels attached to the corresponding fore panels.

As depicted in FIGS. 13-14, the plurality of armored panels 44 can include at least one fore panel 48 further comprising a hinged bracket 50 securable to at least one of the mount plates 46 to rotatably mount the fore panel 48 to the mount plate 46. In one aspect, the hinged bracket 50 can be affixed to one of the mount plates 46 at one end and affixed to the weapon/equipment mount plate 34. In another aspect, the fore panel hinge bracket 50 can be directly mounted to the hatch ring 30 as depicted in FIG. 6. The fore panel 48 can be rotated between a generally horizontal position in which the fore panel 48 is generally parallel to the mount plate 46 and a generally vertical position in which the fore panel 48 is generally upright. In one aspect, the fore panel 48 is angled relative to the mount plate 46 such that the fore panel 48 is angled radially inward toward the hatch opening 26 when the mount plate 46 is affixed to the hatch ring 30. The inward angle of the fore panel 48 allows the fore panel 48 to deflect ballistic threats, shrapnel or debris upwards away from the gunner.

As depicted in FIG. 13. In one aspect, each fore panel 48 can further comprise a fold out panel 52 and a fold out hinged bracket 54 rotatably affixing the fold out panel 52 to the fore panel 48. The fold out panel 52 is rotatable between a retracted position in which the fold out panel 52 is positioned against fore panel 48 decreasing the overall surface area of the fore panel 48 and a deployed position in which the fold out panel 52 extends from the fore panel 48 increasing the overall surface area of the fore panel 48 as depicted in FIG. 14. As depicted in FIG. 14, in one aspect, the fold out panel 52 can comprise an L-shape such that a second L-shaped fold out panel 52 of an opposing fore panel 48 can cooperate to define a U-shaped opening for receiving a weapon.

Figure 12:
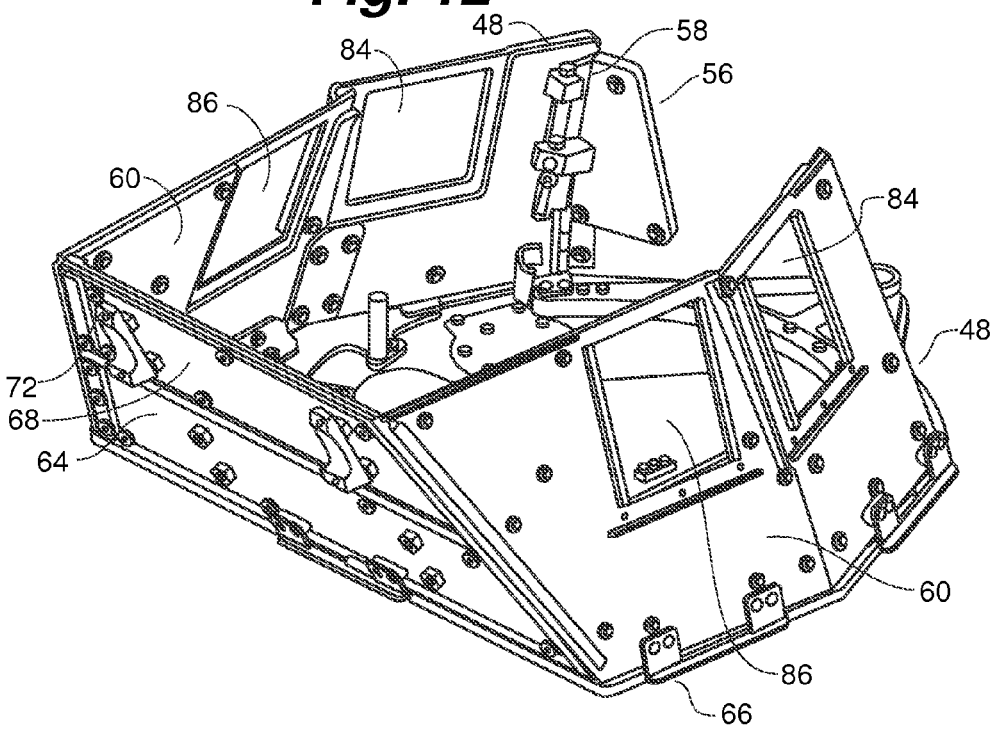
FIG. 12 is a rear perspective view of a hatch with both fore panels, both side panels and the back panel affixed to the corresponding hinged brackets, according to an embodiment of the present invention, wherein the secondary fold out panel of one of the fore panels is extended.

As depicted in FIG. 12, in one aspect, each fore panel 48 can further comprise a secondary fold out panel 56 and a hinged bracket 58 rotatably affixing the secondary fold out panel 56 to the fore panel 48. The secondary fold out panel 56 is rotatable between a retracted position in which the secondary fold out panel 56 is positioned against fore panel 48 and a deployed position in which the secondary fold out panel 56 is positioned within the U-shaped opening to reduce the size of the U-shape opening. The secondary fold out panel 56 can be deployed to change the shape of the opening according to the type of weapon or equipment system mounted on the vehicle 20. Specifically, the secondary fold out panel 56 can be deployed to provide an additional shield protecting the gunner from threats that may otherwise enter through the U-shape opening. The fold out panel 52 and the secondary fold out panel 56 can be deployed in varying combinations according to the type of weapon or equipment system mounted to the vehicle 20.

As depicted in FIGS. 8-15, the plurality of armored panels 44 can include at least one side panel 60 further comprising a side panel hinged bracket 62 securable to at least one of the mount plates 46 to rotatably mount the side panel 60 to the mount plate 46. In one aspect, the hinge bracket 62 can be directly mounted to the hatch ring 30 as depicted in FIG. 6. As depicted in FIGS. 17, 17*a*, 17*b*, and 17*c* the side panel 60 can be rotated between a generally horizontal position in which the side panel 60 is generally parallel to the mount plate 46 and a generally vertical position in which the side panel 60 is generally upright. In one aspect, the side panel 60 is angled relative to the mount plate 46 such that the side panel 60 is angled radially inward toward the hatch opening 26 when the mount plate 46 is affixed to the hatch ring 30. The inward angle of the side panel 60 allows the side panel 60 to deflect ballistic threats, shrapnel or debris upwards away from the gunner. In one aspect, the hinged bracket 62 can further comprise an integrated rifle mount 63 for mounting an infantry weapon when the side panel 60 is lowered into the generally horizontal position, wherein the infantry weapon can be operated through the opening in the armored envelope created by the lowered side panel 60.

As depicted in FIGS. 8-15, the plurality of armored panels 44 can include at least one back panel 64 further comprising a back panel hinged bracket 66 securable to at least one of the mount plates 46 to rotatably mount the back panel 64 to the mount plate 46. In one aspect, the hinged bracket 66 of the back panel 64 can extend between the mirrored mount plates 46. In another aspect, the hinge bracket 66 can be directly mounted to the hatch ring 30 as depicted in FIG. 6. As depicted in FIGS. 17, 17*a*, 17*b*, and 17*c*, the back panel 64 can be rotated between a generally horizontal position in which the back panel 64 is generally parallel to the mount plate 46 and a generally vertical position in which the back panel 64 is generally upright. Obviously, the panels can be rotated on top of the hatch opening during transportation. In one aspect, the back panel 64 is angled relative to the mount plate 46 such that the back panel 64 is angled radially outward away from the hatch opening 26 when the mount plate 46 is affixed to the hatch ring 30. The outward angle of the back panel 64 can direct back blast from a weapon system such as a missile launcher, rocket launcher or recoilless rifle upwards out away from the vehicle 20 rather than downward into the hatch opening 26 or back at the gunner.

Figure 8:
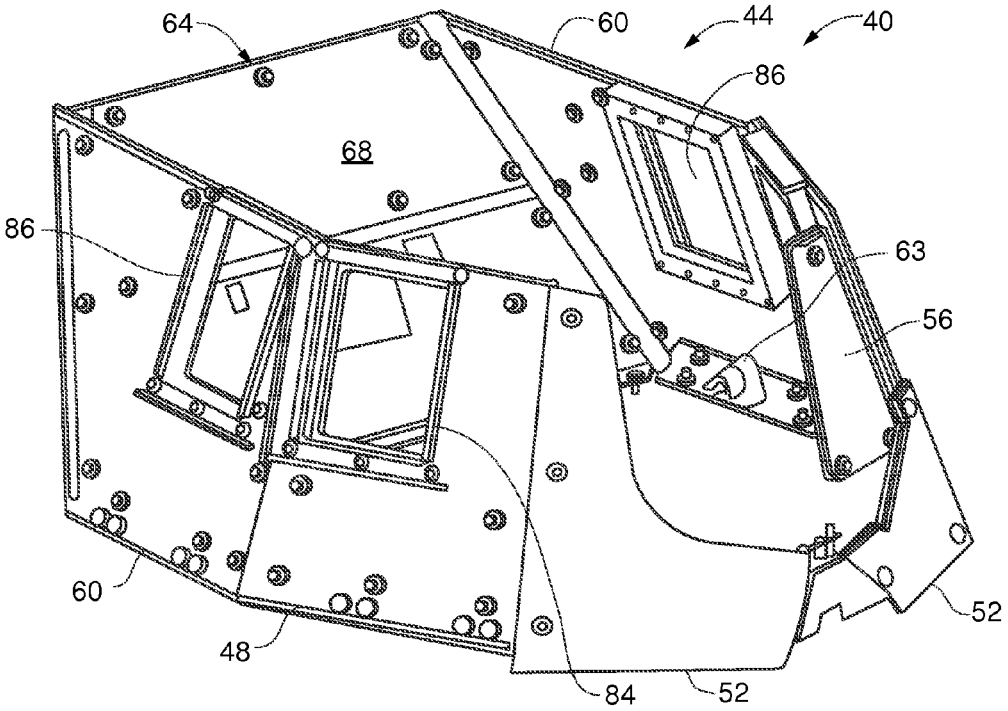
FIG. 8 is a front perspective view of a plurality of armored panels arranged to define an armored envelope according to an embodiment of the present invention.
Figure 9:
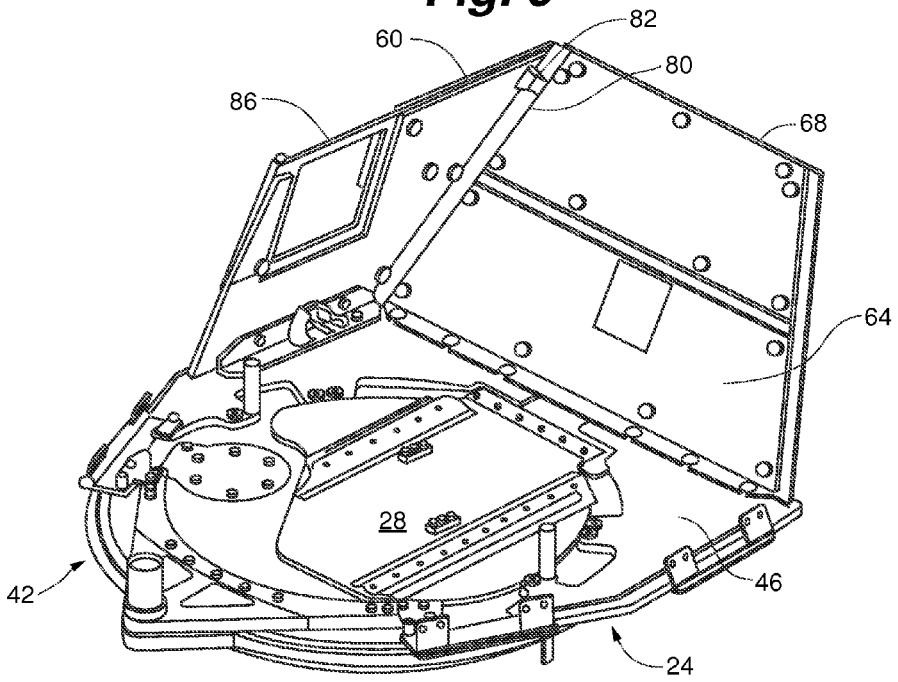
FIG. 9 is a front perspective view of a hatch with a side panel and a back panel affixed to the corresponding hinged brackets according to an embodiment of the present invention.
Figure 10:
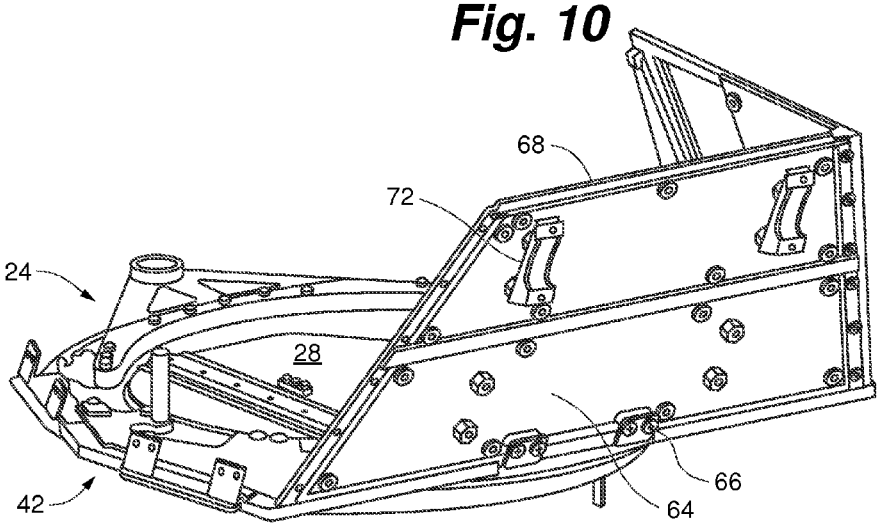
FIG. 10 is a rear perspective view of the hatch depicted in FIG. 9.
Figure 11:
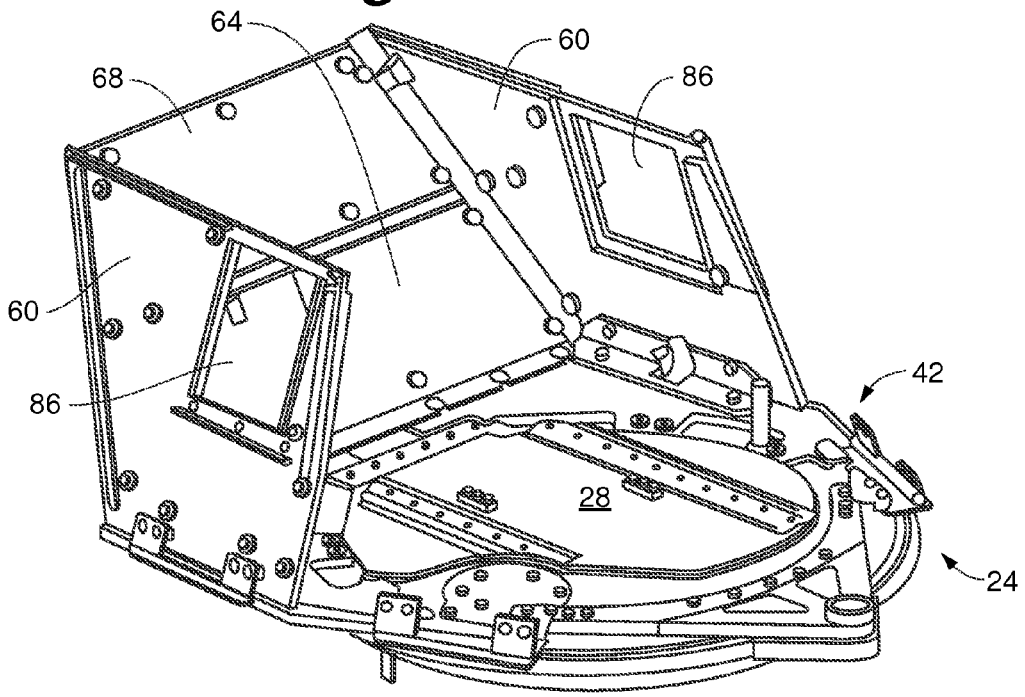
FIG. 11 is a front perspective view of a hatch with both side panels and back panel affixed to the corresponding hinged brackets according to an embodiment of the present invention.

As depicted in FIGS. 8-10, the back panel 64 can further comprise a fold out back panel 68 and a hinged bracket 70 rotatably affixing the fold out back panel 68 to the back panel 64. The fold out back panel 68 can rotated between a deployed position in which the fold out back panel 68 is in alignment with the back panel 64 and a retracted position in which the fold out back panel 68 is positioned against the back panel 64. When the fold out back panel 68 is positioned in the deployed position the fold out back panel 68 increases the protective area provided by the back panel 64. The fold out back panel 68 can be lowered to provide a second opening opposite the opening defined by the fore panels 48 through which the back blast from the weapon system can be directed safely. In one aspect, the back panel 68 can further comprise a stop 72 for positioning the fold out back panel 68 when the fold out back panel 68 is rotated into the retracted position.

As depicted in FIGS. 8 and 12, the plurality of armored panels 44 are arranged on the mount plates 46 such that the armored panels 44 define a U-shaped armored envelope surrounding the hatch opening 26 when the mount plates 46 are affixed to the hatch ring 30 and the armored panels 44 are rotated into the generally vertical orientation. In this configuration, the fore panels 48 correspond to the ends of the "U", wherein the U-shaped opening defined by the L-shaped fold out panels 52 corresponds to the gap in the "U". Similarly, the side panels 60 define the arms of the "U" while the back panel 64 defines the junction of the arms of the "U". As depicted in FIGS. 17, 17*a*, 17*b*, and 17*c*, the armored panels 44 can be individually raised or lowered to change the shape of the armored envelope or change the size of the opening through which the weapon or equipment system can be operated. The individual orientation of the armored panels 44 allows the armored envelop to be configured for the particular weapon or equipment system mounted to the vehicle 20.

As depicted in FIG. 13, the fore panels 48 further comprises an engagement assembly 74 for affixing the fore panels 48 to the corresponding side panels 60 when the fore panels 48 and the side panels 60 is rotated to into the vertical orientation. The engagement assembly 74 can further comprise an engagement panel 76 for receiving a plurality of fasteners 78 for affixing the engagement panel 76 to both the fore panel 48 and the corresponding side panel 60 to secure the fore panel 48 to the side panel 60. In one aspect, a portion of the fore panel 48 overlaps with the corresponding side panel 60. A fastener 78 can be inserted through the overlapping portion to affix the fore panel 48 to the side panel 60. As depicted in FIG. 9, the side panel 60 can further comprise an L-shape bracket 80 for receiving a plurality of fasteners 78 to affix the back panel 64 to the side panel 60. In one aspect, a clip spring 82 can be affixed to the side panel 60 and back panel 64 to clip the panels 60, 64 together.

In one embodiment of the present invention, the fore panel 48 further comprises an armored window 84. Similarly, the side panel 60 can also comprise armored window 86. The armored windows 84, 86 can be aligned with the sight lines of the gunner when operating the weapon or equipment system.

Figure 15:
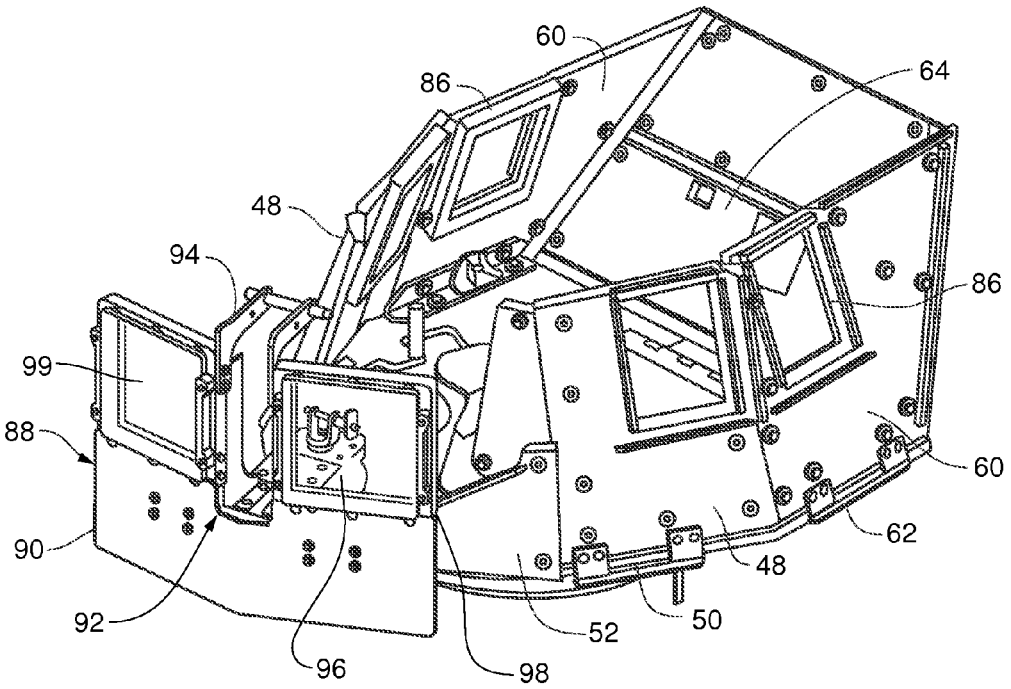
FIG. 15 is a perspective view of a hatch with a plurality of armored panels and a gun shield arranged around the hatch to define an armored envelope according to an embodiment of the present invention.
Figure 16:
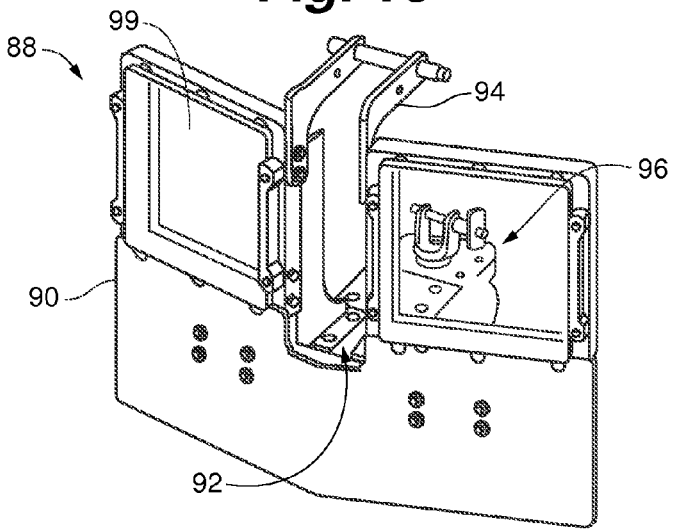
FIG. 16 is a perspective view of a gun shield according to an embodiment of the present invention.
Figure 17:
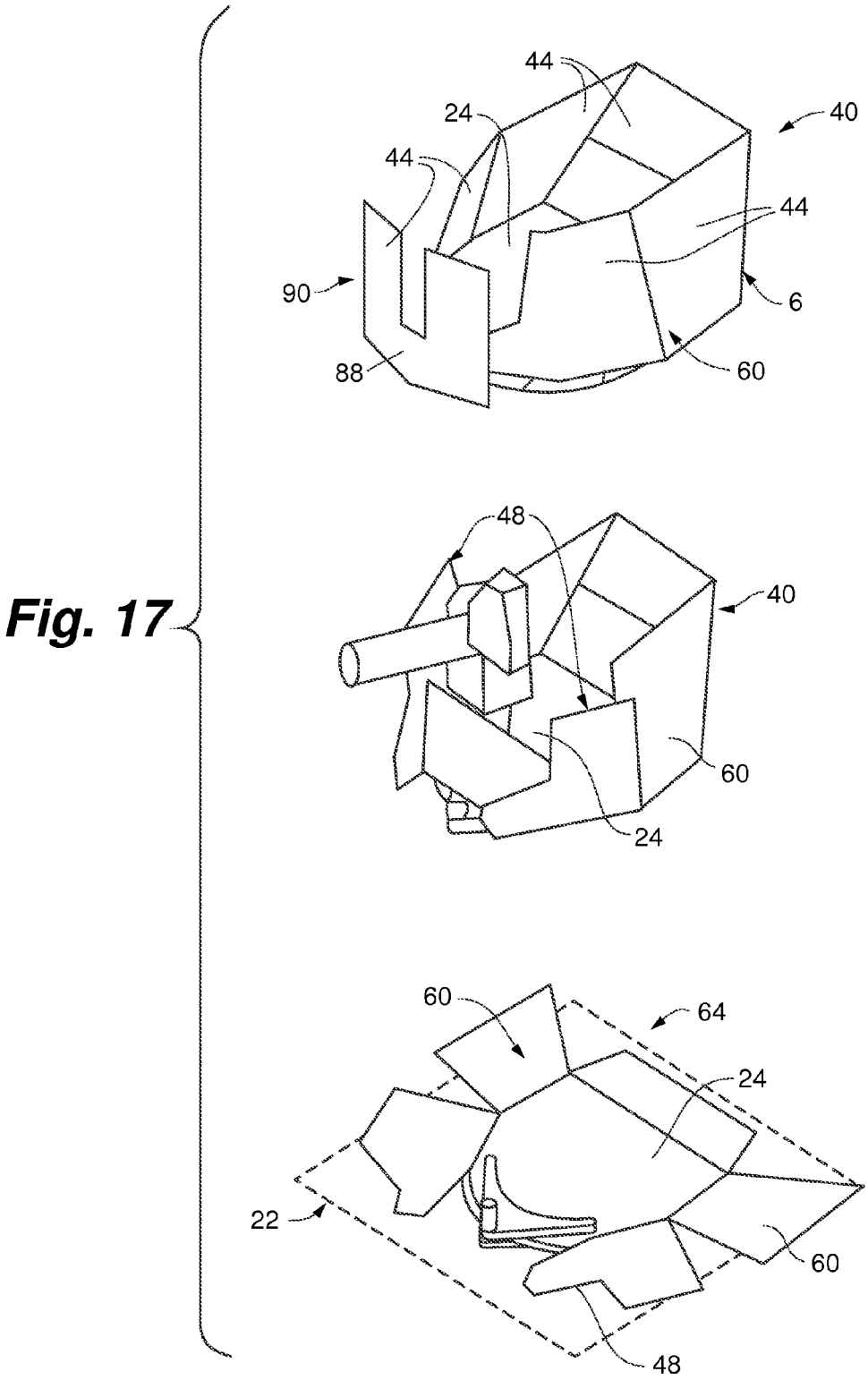
FIGS. 17, 17*a*, 17*b*, and 17*c* are a set of perspective drawings depicting the operation and elements of the present invention.
Figure 17A:
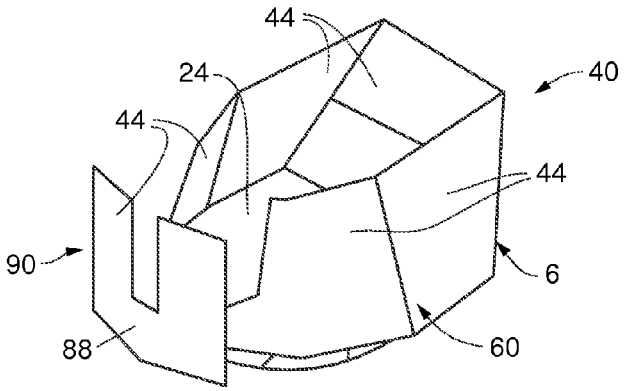
Figure 17B:
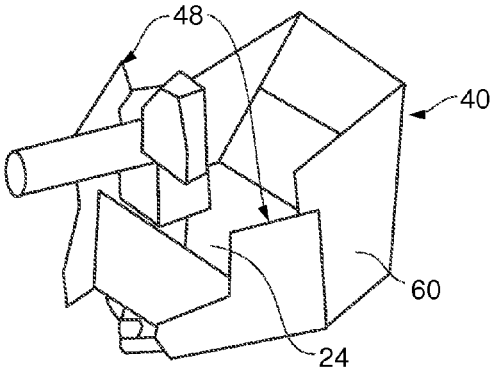
Figure 17C:
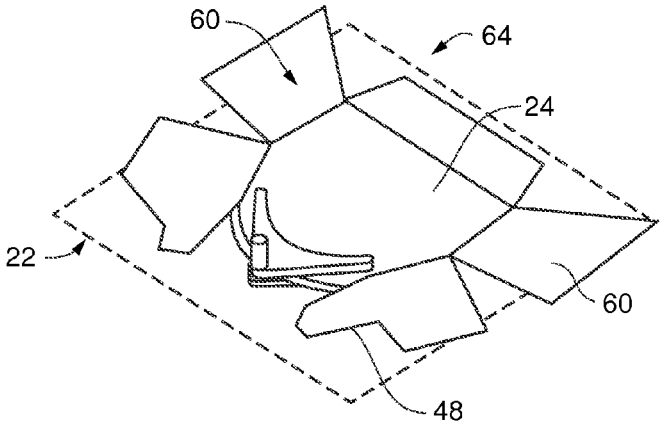
Figure 18:
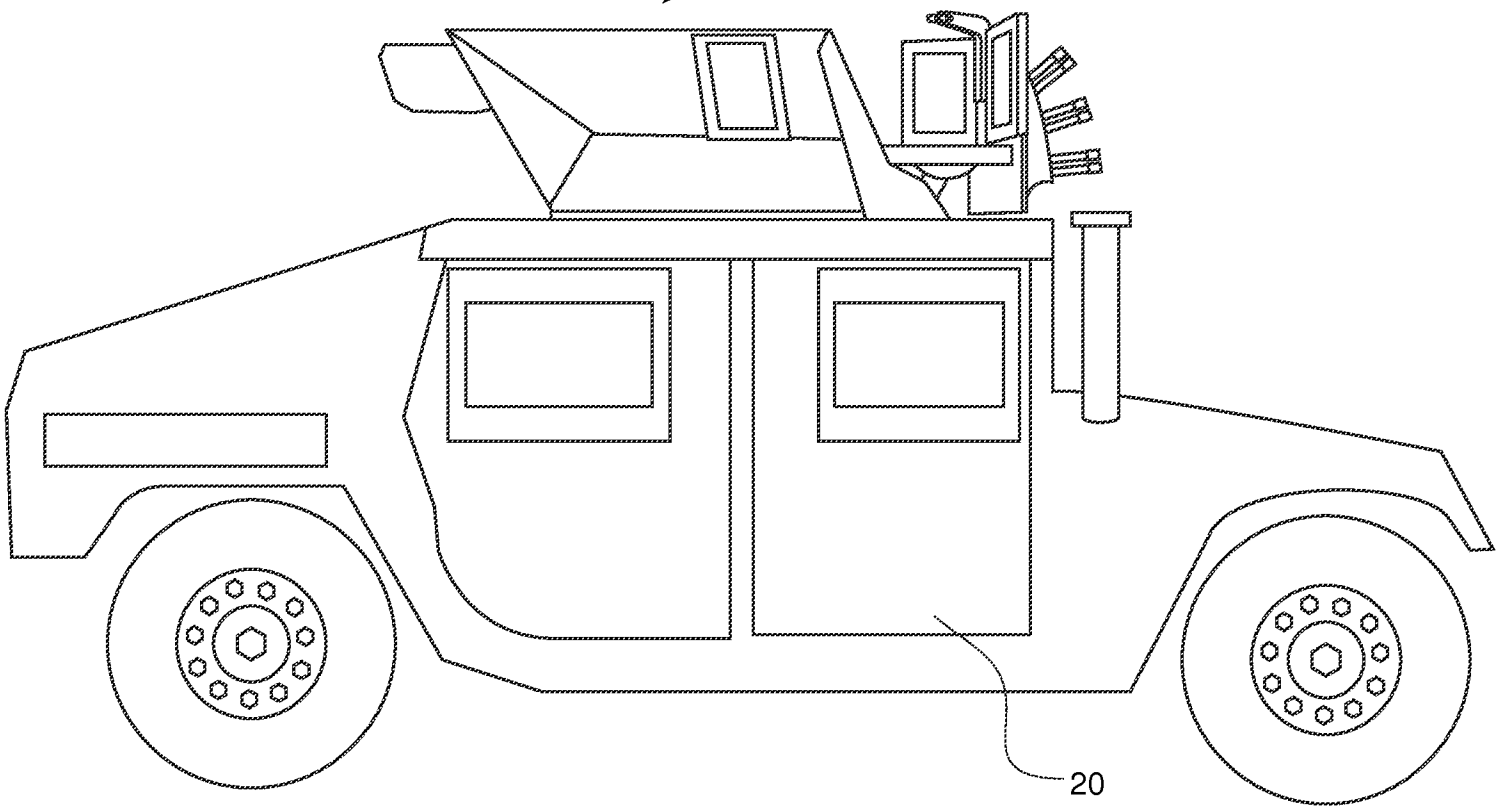
FIG. 18 is a perspective view of the present invention mounted on an armored vehicle.

As depicted in FIG. 15-16, in one embodiment of the present invention, the gunner protection system 40 can further comprise a gun shield 88 having an armored panel 90 defining a slot 92. The gun shield 88 can be fitted to gun system such that the barrel or a portion of the action of the gun is positioned within the slot 92. The armored panel 90 is sized to overlap with the edges of the U-shaped opening defined by the fore panel 48. In one aspect, the gun shield 88 can further comprise a gun mount 94 for affixing the gun shield 88 directly to the gun. In another aspect, the gun shield 88 can further comprise a mount assembly 96 for linking the gun shield 88 to a corresponding shield mount 98 on at least one of the L-shaped fold out panel 52 as depicted in FIG. 15. In one aspect, the gun shield 88 can further comprise at least one armored window 99. In operation, the gun shield 88 can be affixed to the armored panels 44 to the gun system and removed when a different weapon or equipment system is mounted to use the larger U-shaped opening.

The embodiments above are intended to be illustrative and not limiting. Additional embodiments are encompassed within the scope of the claims. Although the present invention has been described with reference to particular embodiments, those skilled in the art will recognize that changes may be made in form and detail without departing from the spirit and scope of the invention.

We Claim:

1. A gunner protection kit for providing an armored envelope around a vehicle roof hatch opening, comprising:

a plurality of armored panels, including:

a fore panel individually rotatable between a horizontal orientation and a generally vertical orientation, wherein the fore panel defines a portion of the armored envelope when rotated into the generally vertical orientation, the fore panel including at least one fold out panel rotatably affixed to the fore panel, a side panel individually rotatable between a horizontal orientation and a generally vertical orientation, wherein the side panel defines a portion of the armored envelope when rotated into the generally vertical orientation, and at least one back panel individually rotatable between a horizontal orientation and a generally vertical orientation, wherein the back panel defines a portion of the armored envelope when rotated into the generally vertical orientation;

wherein the fore panel defines an opening when rotated into the vertical orientation through which a weapon or equipment system can be operated, the at least one fold out panel being rotatably deployed into said opening to modify a shape of the opening to conform to the weapon or equipment system to be operated, said opening partially filled by a gun shield; wherein the side panel is positioned adjacent to the fore panels and the back panel;

and at least one mount plate disposed on top of the roof, the mount plate including a hatch on the vehicle roof hatch opening and a weapon mounting plate, the hatch including a seal to close the vehicle roof hatch opening;

wherein the fore panel further comprises at least one hinged bracket for rotatably mounting the fore panel to the mount plate;

wherein the side panel further comprises at least one hinged bracket for rotatably mounting the fore panel to the mount plate; and wherein the back panel further comprises at least one hinged bracket for rotatably mounting the fore panel to the mount plate.

2. The gunner protection kit of claim 1, wherein the mount plate further comprises a handle for egress from the vehicle.

3. The gunner protection kit of claim 1, wherein the fore panel further comprises a secondary fold out panel rotatably affixed to the fore panel;

wherein the secondary fold out panel is rotatably deployable into said opening to further modify the shape of the opening to conform to the weapon or equipment system to be operated.

4. The gunner protection kit of claim 1, wherein the back panel can further comprise a fold out back panel having a hinged bracket rotatably affixing the fold out back panel to the back panel;

wherein the fold out back panel is rotated between a retracted position in which the fold out back panel is folded against the back panel to define a second opening opposite the opening defined by the fore panels and a deployed position where the fold out panel is aligned with the back panel to expand the surface area of the back panel.

5. The gunner protection kit of claim 1, wherein a portion of the fore panel overlaps with a portion of the adjoining side panel so that when the fore panel and side panel are rotated into the vertical orientation a fastener can be fitted through the overlapping portions of the fore panel and side panel to affix the fore panel to the side panel.

6. The gunner protection kit of claim 1, wherein the side panel further comprises an engagement assembly for affixing the side panel to the adjoining fore panel when the fore panel and side panel are rotated into the vertical orientation.

7. The gunner protection kit of claim 1, wherein the back panel comprises at least one engagement assembly corresponding to the side panel to affix the side panel to the back panel when the side panel and back panel are rotated into the vertical orientation.

8. The gunner protection kit of claim 1, wherein the gun shield includes a support that extends a gun shield armored panel forward of the fore panel so that the entire gun shield is rotatable about the weapon mounting plate, wherein the armored panel defining a slot for receiving a portion of the weapon or equipment system and a weapon mount for affixing the gun shield to the weapon or equipment system.

9. The gunner protection kit of claim 8, wherein the armored panel of the gun shield further comprises at least one armored window.

10. The gunner protection kit of claim 1, wherein the fore panel comprises at least one armored window.

11. The gunner protection kit of claim 1, wherein the side panel comprises at least one armored window.

12. The gunner protection kit of claim 1, wherein each fore panel and side panel is angled inward toward the center of the roof hatch when rotated from the generally horizontal orientation.

13. The gunner protection kit of claim 1, wherein the back panel is angled radially outward away from the center of the roof hatch when rotated into from the generally horizontal orientation.

14. A method for protecting a gunner operating a roof mounted weapon or equipment system through a roof hatch of a vehicle, comprising:

a mount plate disposed on top of the roof, said mount plate including a hatch that seals the interior of the vehicle when the hatch is closed and a plurality of armored panels, including:

at least two fore panels, each fore panel including at least one fold out panel that is rotatably affixed to the corresponding fore panel, at least two side panels, and at least one back panel;

positioning the plurality of armored panels around the roof hatch such that the panels partially encircle the roof hatch, wherein a gap in the armored panels is defined between the fore panels; and individually rotating at least one of the armored panels into a generally vertical orientation to create an armored envelope shielding the gunner from ballistic threats, said armored panel rotating from a first position parallel to the roof to a second vertical position, the first position not obstructing the roof hatch, defining at least one opening between the at least two fore panels through which the weapon or equipment system can be operated; and modifying a shape of the opening by rotatably deploying the fold out panels into the opening.

15. The method of claim 14, further comprising:

adjusting the size and shape of the armored panels according to the geometry of the mounted weapon or equipment system by rotating different combinations of armored panels between the generally vertical orientation and the generally horizontal orientation.

16. The method of claim 14, further comprising:

rotating all of the armored panels into the generally horizontal orientation to collapse the armored envelope and lower the overall height of the vehicle to allow for more efficient transport of the vehicle.

17. The method of claim 14, further comprising:

rotating the back panel into the generally horizontal orientation so as not to block the roof hatch to create an opening in the armored envelope through which back blast from the weapon or equipment system can be directed.

18. The method of claim 14, further comprising:

mounting a gun shield to the mount plate, wherein the gun shield comprises an armored panel defining a slot for receiving at least a portion of the weapon or equipment system;

wherein the armored panel of the gun shield is sized to overlap with the fore panels.

19. A gunner protection kit for providing an armored envelope around a vehicle roof hatch opening, comprising:

a plurality of armored panels, including:

a pair of fore panels individually rotatable between a horizontal orientation and a generally vertical orientation, wherein the fore panel defines a portion of the armored envelope when rotated into the generally vertical orientation, each fore panel including at least one fold out panel rotatably affixed to the fore panel, the fore panels defining an opening therebetween when in the generally vertical orientation;

at least one back panel individually rotatable between a horizontal orientation and a generally vertical orientation, wherein the back panel defines a portion of the armored envelope when rotated into the generally vertical orientation;

at least a pair of side panels individually rotatable between a horizontal orientation and a generally vertical orientation, wherein each side panel defines a portion of the armored envelope when rotated into the generally vertical orientation, each side panel being positioned adjacent to the corresponding fore panel and the back panel, and wherein each fold out panel is rotatably deployable from the corresponding fore panel into said opening to modify a shape of the opening to conform to a weapon or equipment system to be operated; and and at least one mount plate disposed on top of the roof, the mount plate including a hatch on the vehicle roof hatch opening and a weapon mounting plate, the hatch including a seal to close the vehicle roof hatch opening;

wherein the fore panel further comprises at least one hinged bracket for rotatably mounting the fore panel to the mount plate;

wherein the side panel further comprises at least one hinged bracket for rotatably mounting the fore panel to the mount plate; and wherein the back panel further comprises at least one hinged bracket for rotatably mounting the fore panel to the mount plate.

20. The gunner protection kit of claim 19, wherein said opening is partially filled by a gun shield.

* * * * *